United States Patent [19]

Kennard, Jr. et al.

[11] Patent Number: 4,615,450

[45] Date of Patent: Oct. 7, 1986

[54] PORTABLE AND COLLAPSIBLE DERRICK STRUCTURE

[76] Inventors: Dwight C. Kennard, Jr., 3830 Incochee Trail, Traverse City, Mich. 49684; James C. Kennard, P.O. Box 76, Maple City, Mich. 49664

[21] Appl. No.: 621,154

[22] Filed: Jun. 15, 1984

[51] Int. Cl.[4] ..... B66C 23/42

[52] U.S. Cl. ..... 212/187; 212/180; 212/183

[58] Field of Search ..... 212/180, 182, 183, 185, 212/186, 187, 188, 239, 262; 52/113, 114, 116, 117, 120

[56] References Cited

U.S. PATENT DOCUMENTS

| | | | |
|---|---|---|---|
| 1,349,635 | 8/1920 | Strauss | 52/116 |
| 1,658,873 | 2/1928 | Younkman et al. | 212/222 |
| 2,327,461 | 8/1943 | Rowe | 254/327 |
| 2,364,851 | 12/1944 | Johansen | 52/119 |
| 2,610,743 | 9/1952 | English et al. | 212/183 |
| 2,615,538 | 10/1952 | Pelaez | 52/116 |
| 2,616,666 | 11/1952 | Honey | 254/327 |
| 2,682,957 | 7/1954 | Holmes | 212/188 |
| 2,687,809 | 8/1954 | Balogh | 212/186 |
| 2,887,191 | 5/1959 | Lovell | 52/115 |
| 3,015,374 | 1/1962 | Carbert et al. | 52/120 |
| 3,059,781 | 10/1962 | Bender et al. | 212/165 |
| 3,273,722 | 9/1966 | Priest et al. | 212/175 |
| 3,276,610 | 10/1966 | Thatcher | 414/541 |
| 3,794,192 | 2/1974 | Monson | 414/541 |
| 3,797,672 | 3/1974 | Vermette | 212/180 |
| 4,068,762 | 1/1978 | Kennard, Jr. et al. | 212/188 |

FOREIGN PATENT DOCUMENTS

| | | | |
|---|---|---|---|
| 605262 | 7/1948 | United Kingdom | 212/187 |
| 990959 | 5/1965 | United Kingdom | 52/116 |

*Primary Examiner*—Trygve M. Blix
*Assistant Examiner*—Thomas J. Brahan
*Attorney, Agent, or Firm*—Price, Heneveld, Huizenga & Cooper

[57] ABSTRACT

A pickup truck derrick assembly includes a base frame, a derrick A-frame pivotally mounted on the base frame, a derrick frame erection subassembly, a frame support and locking subassembly and a cable compensation system. The frame erection subassembly includes an elongated track. A roller or carriage subassembly rides on the track and engages the A-frame. Movement of the carriage along the track raises and lowers the A-frame. The A-frame is held in an erected position by support braces pivotally connected at one end to the base frame. Each brace slidably engages a sleeve mounted on the A-frame. A locking mechanism automatically secures the braces to the sleeves when the A-frame is erected. A pulley and cable arrangement including a compensation pulley on a support arm fixed to the A-frame compensates for hoist cable slackening when the A-frame is pivoted to its storage position.

35 Claims, 8 Drawing Figures

PORTABLE AND COLLAPSIBLE DERRICK STRUCTURE

BACKGROUND OF THE INVENTION

This invention relates to a collapsible support assembly, and more particularly, to improvements in a portable, collapsible derrick structure.

In various operations, such as building construction, boat launching and general warehouse moving, a need exists for a temporary hoist which can be transported to the work site, is quickly and easily erected from a collapsed, transporting position to an erected, operating position and is very stable during use. Several truck mounted arrangements are available which have an erectable derrick structure.

A portable assembly is shown in U.S. Pat. No. 4,068,762 entitled PICKUP TRUCK DERRICK, issued Jan. 17, 1978 to the present inventor. This patent discloses a collapsible boom and derrick hoist assembly having a base frame securable to the side rails of a pickup truck. A collapsible A-frame is pivotally mounted to the front end of the base frame. In the collapsed, folded position, the A-frame rests over the tailgate of the pickup truck. While in the erected position, the A-frame rises above the front end of the truck bed. The assembly also provides a brace for supporting the A-frame when the A-frame is in the erected position.

The hoist assembly includes an A-frame erection system for raising the A-frame to its operating position. In one embodiment, the erection system includes a winch and pulley arrangement located near the truck cab and a subassembly located near the tailgate for increasing the mechanical advantage of the winch. In another embodiment, the A-frame erection system has a pair of U-shaped rails attached to the side rails of the base frame. Each leg of the A-frame is pivotally mounted to a slider assembly which in turn is slidably mounted to the U-shaped rails. Pulling the sliders toward the front of the truck erects the A-frame to its vertical position near the front end of the truck bed.

The hoist assembly includes a foldable, two-piece boom which is supported by the A-frame and which is erected by means of a winch, cable and strut arrangement. The hoist assembly also includes a boom swinging mechanism for rotating the boom about its vertical axis, a boom elevating system for raising and lowering the boom, and a hoisting system for lifting a load.

U.S. Pat. No. 3,059,781 to Bender, entitled MATERIAL HANDLING DEVICE, issued Oct. 23, 1962 discloses a derrick elevating mechanism having a roller type structure. The elevating mechanism has a track spanned by a hydraulic powered roller assembly. A connecting arm extends between the roller assembly and a pivotal mast. Actuation of the hydraulic ram draws the roller up the track, causing the connecting arm to pivot the mast from a horizontal to a vertical position.

U.S. Pat. No. 3,797,672 to Vermette, entitled APPARATUS ATTACHABLE TO A TRUCK BODY OR THE LIKE FOR USE FOR HOISTING OR LIFTING, OR AS AN ELEVATED SUPPORT, issued on Mar. 19, 1974 discloses a latching mechanism used to lock a support brace to a derrick frame. The latching mechanism includes an upright auxiliary support brace having attached thereto an upper spring activated latch and a lower, gravity activated latch. As the derrick frame is raised to its elevated position, the upper latch engages the pin attached to the derrick to secure the derrick to the upright support. Simultaneously, the lower latch engages another pin attached to the derrick frame to lock the derrick in the upright position. In this arrangement, the operator must actually handle the latch mechanism to disengage it when it is in an upright position. Thus, the latch mechanism must be located near the base of the derrick frame so as to be within reach of the operator. Consequently, additional support braces and/or support wires must be used to support the upper portions of the derrick frame.

In the above derrick assemblies which include a hydraulic ram, the derrick erection system is connected to the derrick near the derrick pivot point. Consequently, considerable amounts of force must be developed by the erection assembly because the load on the ram is very high during the initial movement of the derrick due to the positioning of the erection system with respect to the derrick. In addition, in assemblies having a derrick fixed and pivoted to the base frame, the hoisting cable shortens due to the cable wrapping around its guide pulleys as the boom and A-frame are lowered. Cable shortening causes the cable to retract, and this retraction can result in the hooked end of the hoisting cable jamming into its guide pulley located at the end of the boom.

Therefore, a need exists for a cable system which will not retract as the derrick and boom are lowered. A need also exists for a bracke system which supports the upper portions of the derrick frame, which engages automatically as the derrick is raised, and which locks automatically once the derrick is erected. A need also exists for a derrick erection system which does not require auziliary erection systems or overhead cables and pulleys.

SUMMARY OF THE INVENTION

In accordance with the present invention, an improved, portable derrick assembly is provided which can be raised by a winch and cable system from a collapsed, transporting position to an erected, operating position and which, when erected, can be securely braced and locked in that operating position. Essentially, the collapsible derrick assembly includes a base frame, an A-frame structure pivotally secured to the base frame, and a brace leg pivotally secured at one end to the base frame and slidably engaged at the other end with the A-frame. Provision is made for simultaneously raising both the A-frame and its support brace to an erected, operating position and for securely latching the support brace to the upper portion of the A-frame once the A-frame is erected. Provision is also made for disengaging the latching mechanism so that the A-frame can be lowered to its collapsed, transporting position. Provision is further made for preventing the hooked end of the hoisting cable from jamming into the guide pulley as the A-frame is lowered.

In the narrower aspects of the invention, the derrick erecting system utilizes a roller assembly which moves along a track and which engages the derrick structure. As the assembly moves along the track, it wedges under the derrick, thereby raising the derrick by causing it to rotate about its pivotal mounting. The derrick erection system of the present invention eliminates the need to use overhead erection cables and pulleys. The system is mechanically less complex and more easily used than prior approaches.

A folding brace and latching mechanism is also provided which securely locks the A-frame into its erected, operating position. The brace is attached to both the base frame and the A-frame and is raised as the A-frame is raised to its operating position. When the A-frame reaches its operating position, a latching mechanism engages the derrick frame and secures the brace to the A-frame.

The derrick assembly, when used in conjunction with a boom and hoisting cable system, is further provided with a hoisting cable slackening system which compensates for the cable shortening that occurs when the hoisting cable wraps around its guide pulleys as the derrick is lowered to its folded, transporting position. As the derrick assembly is lowered, the cable slackening system prevents the hooked end of the hoisting cable from retracting into its guide pulley and thus eliminates the possibility of the cable snapping as the derrick is lowered.

DETAILED DESCRIPTION OF THE PREFERRED EMBODIMENT

Figure 1:
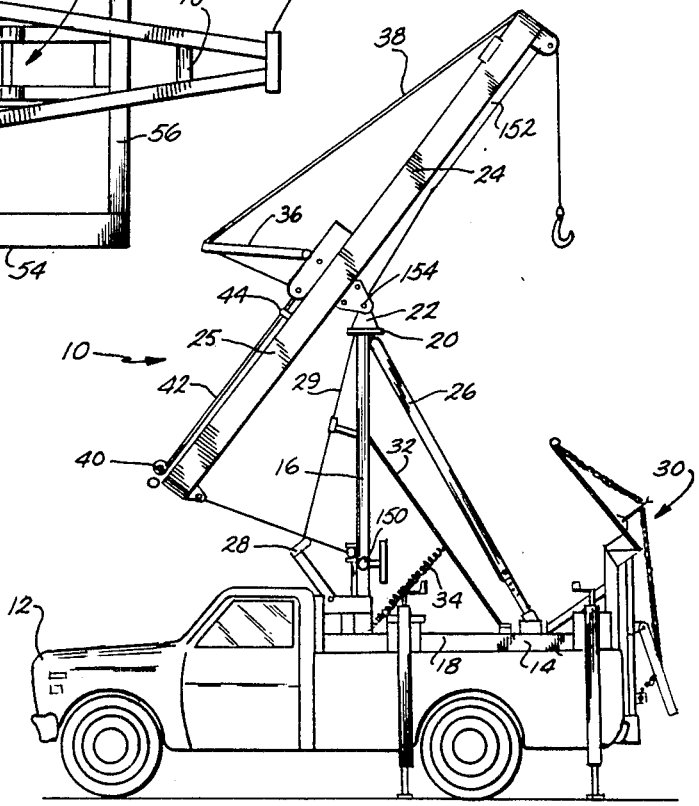
FIG. 1 is a side, elevational view of a pickup truck derrick assembly.

FIG. 1 illustrates a collapsible derrick assembly as disclosed in aforementioned U.S. Pat. No. 4,068,762. As discussed in detail below, the present invention relates to certain improvements in the assembly of FIG. 1. To the extent necessary, the disclosure of U.S. Pat. No. 4,068,762 is hereby incoporated by reference.

In FIG. 1, the assembly is generally designated by the number 10. Assembly 10 is mounted to a conventional pickup truck 12 at side rails 14. The assembly includes a collapsible A-frame 16 pivotally mounted to the front end of a base 18. A boom mounting plate 20 is positioned at the truncated apex of A-frame 16. Plate 20 supports a boom pivot or trunnion assembly 22. Boom sections 24 and 25 are pivotally secured to trunnion assembly 22.

In the collapsed position, A-frame 16 rests over the tailgate of pickup truck 12 while the two sections 24, 25 of the boom fold over the A-frame. In the erected position, A-frame 16 rises above the cab of pickup truck 12 while the two sections 24, 25 of the boom are unfolded and connected together to form a single boom structure. Assembly 10 also includes a pair of telescoping braces 26 which support the A-frame when the A-frame is in the erected position.

Assembly 10 is provided with an erection system for raising the A-frame to its upright position. The erection system includes a differential winch 28 and an overhead cable 29 which is operatively connected to the winch and to the apex of the A-frame. The erection system further includes an auxiliary erecting strut 30 located at the tailgate of truck 12, a pair of chains 32 connected to the A-frame and the base frame, and springs 34 attached to the base frame and the chains, all of which are used to increase the mechanical advantage of winch 28.

Derrick assembly 10 is also provided with a boom erection system for erecting the foldable two-piece boom. A main erection strut 36 is pivotally disposed on the hoist member 24 of the boom assembly. A chain 38 extends from the top of the erection strut 36 to a point near the end of the hoist member 24. A winch 40 is disposed on the lower end of counterbalanced portion 25 of the boom assembly. A cable 42 extends from the winch under a guide cable roller 44 to the end of the main erection strut 36.

Assembly 10 is further provided with a hook hoisting mechanism for lifting loads. The structure and operation of the hook hoisting mechanism will be described below in relation to the cable slackening system improvement of the present invention.

FIGS. 2–8 illustrate various improvements to the derrick assembly disclosed in FIG. 1. The improvements include a new derrick frame erection system, a derrick frame support and locking mechanism, and a cable slackening compensation system.

DERRICK ERECTION SYSTEM

Figure 2:
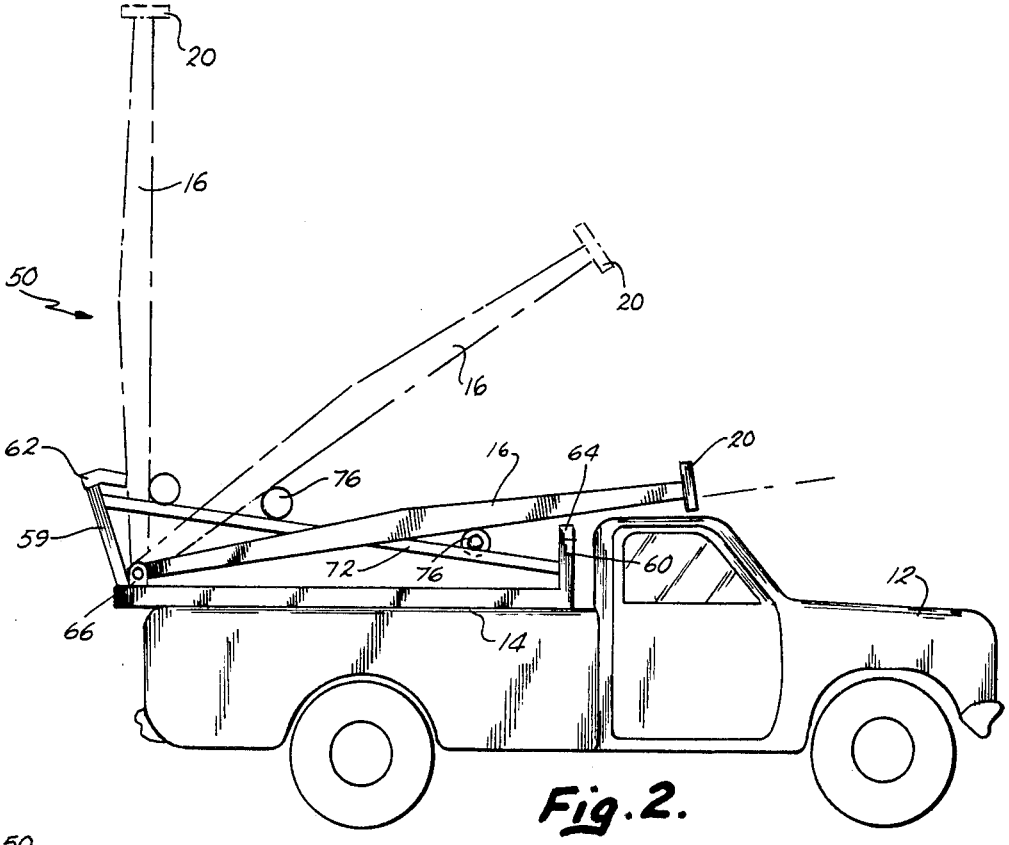
FIG. 2 is a side, elevational view of an A-frame and erection subassembly in accordance with the present invention.
Figure 3:
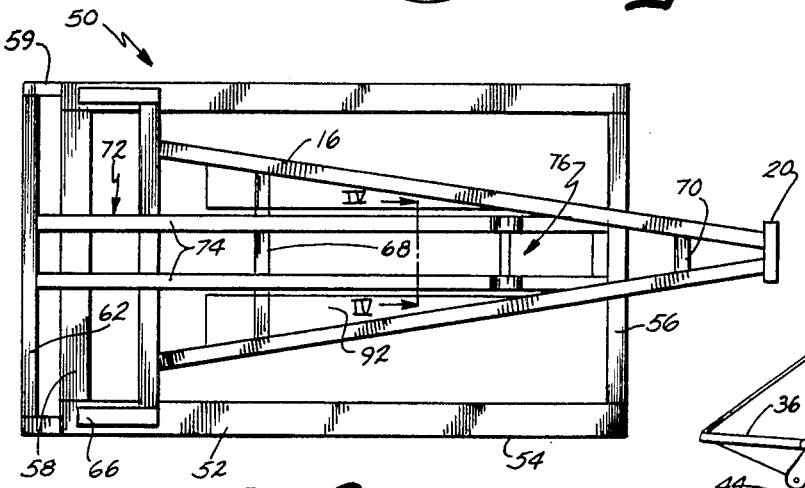
FIG. 3 is a top, plan view of the A-frame and erection subassembly.

FIGS. 2 and 3 illustrate a collapsible derrick assembly in accordance with the present invention and which is generally designated 50. For simplicity and ease of understanding, the boom assembly, hoist cables, support braces and the like as shown in FIG. 1 have not been illustrated. It should be understood that such would be included in the complete derrick.

A base frame or mounting frame 52 of the assembly includes two longitudinal structural members or base members 54 and forward and rear base cross members 56 and 58, respectively. An upper rear cross member 62 is attached to rear struts 59 and an upper front cross member 64 is attached to front struts 60.

A-frame 16 has two legs which converge with each other at the upper end of the A-frame. The lower end of the A-frame is mounted to rear cross member 58 at pivot mountings 66. The two legs of the A-frame are connected to each other by a lower cross brace 68 and an upper cross brace 70. As seen in FIG. 2, A-frame 16 is pivotal from a collapsed, transporting position to an erected, operating position. When the derrick assembly is mounted to a truck, the A-frame, when it is in its transport position, extends over the cab of the pickup truck. When the A-frame is in its erected position, it rises above the tailgate of the pickup truck which positions it to allow for maximum useful reach of the boom.

The raising and lowering of the A-frame is accomplished by the derrick erection system as shown in FIGS. 2, 3, 4 and 5. The system includes a track 72 having a pair of spaced, parallel rails 74 extending from the rear to the front of base frame 52. Preferably, track 72 is inclined by attaching the rear ends of rails 74 to upper rear cross member 62 and the front ends of rails 74 to front base cross member 56. As can be seen in FIG. 2, when the A-frame is in its collapsed position, the rear end of each track 72 lies above the pivoted base of the A-frame and the front end of each track 72 lies below the legs of the A-frame. Alternatively, the track may be horizontal or curved to change the mechanical advantage obtained.

Figure 4:
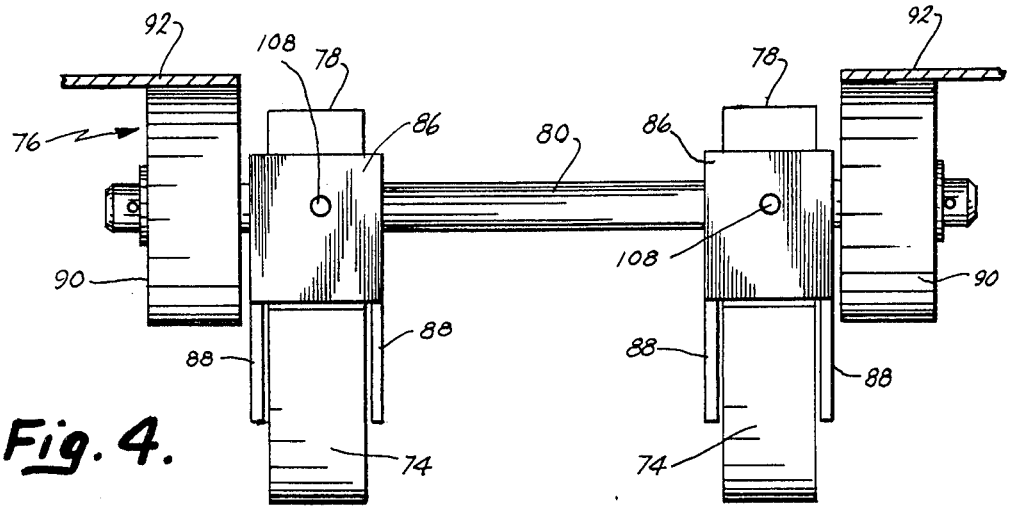
FIG. 4 is a cross-sectional view taken generally along line IV—IV of FIG. 3.
Figure 5:
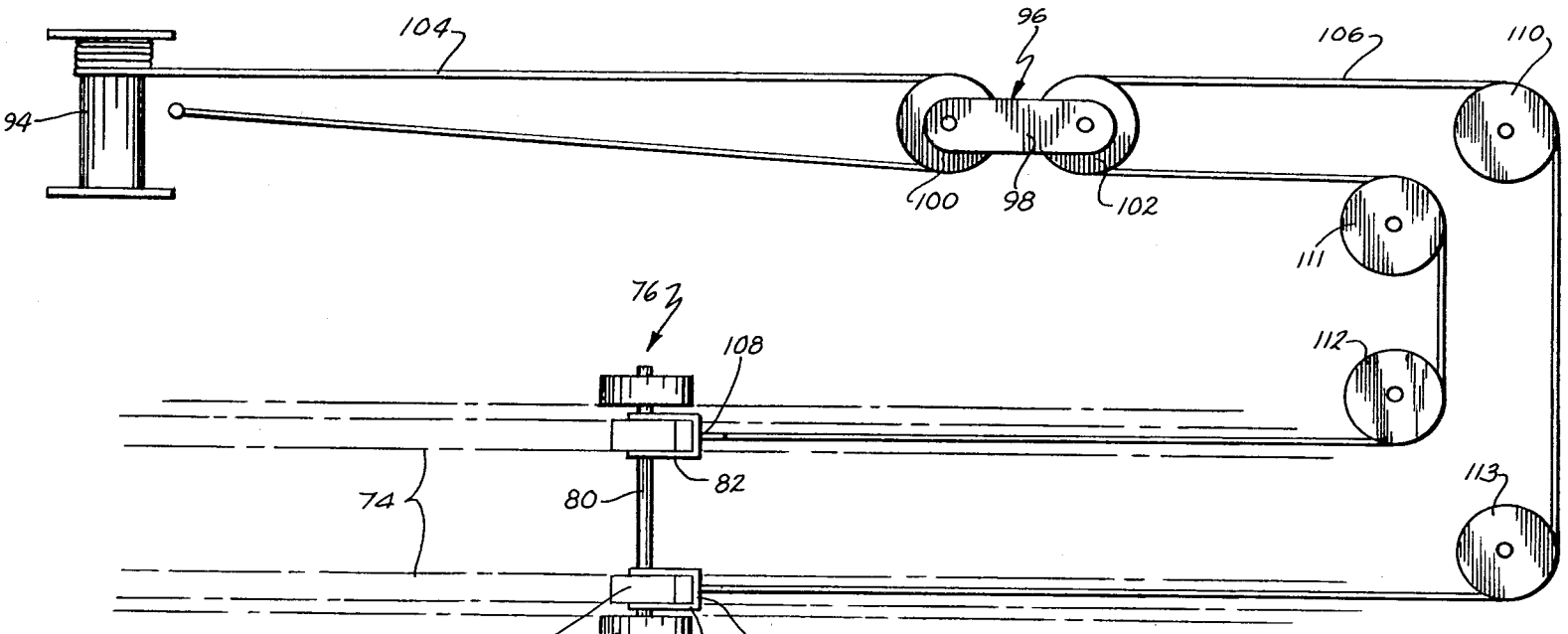
FIG. 5 is a schematic, top, plan view showing the drive or winch and cable portions of the A-frame erection subassembly.

A roller or carriage assembly 76 spans rails 74 and engages with A-frame 16. As shown in FIGS. 4 and 5, the roller assembly 76 includes a shaft 80 having a pair of track engaging rollers 78 rotatably mounted thereon which ride along the upper surface of rails 74. Each roller lies within the interior of a rectangular-shaped carriage or roller frame 82 which is also attached to shaft 80. Frame 82 is defined by two side plates 84 and by a front plate 86 (see FIG. 5). Attached to each side plate 84 is a guide flange 88. Guide flanges 88 extend below the level of track engaging rollers 78. When the roller assembly is placed on track 72, the guide flanges extend along the sides of each of the rails 74, thereby keeping roller assembly 76 on the track.

Roller assembly 76 also includes a pair of A-frame engaging rollers 90 which are rotatably mounted on the ends of shaft 80 such that the two track engaging rollers 78 are positioned between the two A-frame engaging rollers. Rollers 90 roll along triangular-shaped flanges 92 which are attached to the legs of A-frame 16 (see FIG. 3). Flanges 92 provide a continuous surface upon which rollers 90 ride as the width between the legs of the A-frame increases due to the divergence of those legs from the apex to the base. As an alternative, the roller assembly could have only one pair of rollers which would engage both the rails 74 and the A-frame flange 92.

The A-frame erection system further includes a drive means for moving the roller assembly along track 72 and derrick A-frame flange 92. As shown in FIG. 5, the drive means include a winch 94 which is attached to rear cross base member 58 and a pulley block 96 having a block frame 98 and first and seconc pulleys 100 and 102, respectively. A first cable 104 operatively connects winch 94 to first pulley 100. A second cable 106 operatively connects pulley block 96 to roller assembly 76. The ends of cable 106 are each attached to an aperture 108 located in the front cross plate 86 of one of the carriage frames 82. The cable extends to and around second pulley 102. In the alternative, the pulley block could have only one pulley rotatably mounted thereto and could have a cable connected directly to the block frame of the pulley block and to the winch. In another alternative, the pulley block and the second cable could be eliminated completely from the system and a first cable could be attached directly to roller assembly 76.

Cable 106 is wrapped around auxiliary pulley assemblies 110, 111, 112 and 113. The auxiliary pulley assemblies change the direction of cable 106, thereby permitting the winch and cable system to be confined within the area of base frame 52. Pulleys 110–113 also balance the pull forces applied to each end of the roller assembly. This eliminates or limits skewing or mistracking of assembly 76.

In operation, roller assembly 76 is initially positioned at the lower forward end of track 72 when the derrick frame is in its collapsed, transporting position, as shown by the solid lines in FIG. 2. In this position, roller assembly 76 fits into the wedge formed by the intersecting angles of the flat surfaces of the derrick flanges 92 and the upper surface of rails 74. To raise the A-frame, winch 94 reels in cable 104 which in turn pulls pulley block 96 toward the winch. This action in turn pulls roller assembly 76 up the track and toward the pivoted end of the A-frame. Pulling roller assembly 76 along the track wedges that assembly under the A-frame and forces the A-frame engaging rollers 90 to roll along the flanges 92 of the A-frame. This wedging action rotates the A-frame about its pivoted lower end, thereby raising it. Winch 94 is activated until the A-frame is raised to its erected, operating position. The A-frame is lowered by reeling out cable 104. A spring may be used to start rotation of the A-frame upon release of cable 104. Also, the frame may be manually pushed past its center position.

The derrick frame erection system of the present invention eliminates the need to use overhead erection cables and pulleys, such as cable 29 as shown in FIG. 1. The need to use auxiliary erecting strut 30 as shown in FIG. 1 is also eliminated because of the mechanical avantages occurring between the cable forces and the A-frame weight to be raised. Further, pulley block 96, pulley 102 and cable 106 operate to balance the pull forces applied at each track engaging roller 78.

DERRICK FRAME SUPPORT AND LOCKING MECHANISM

Figure 6:
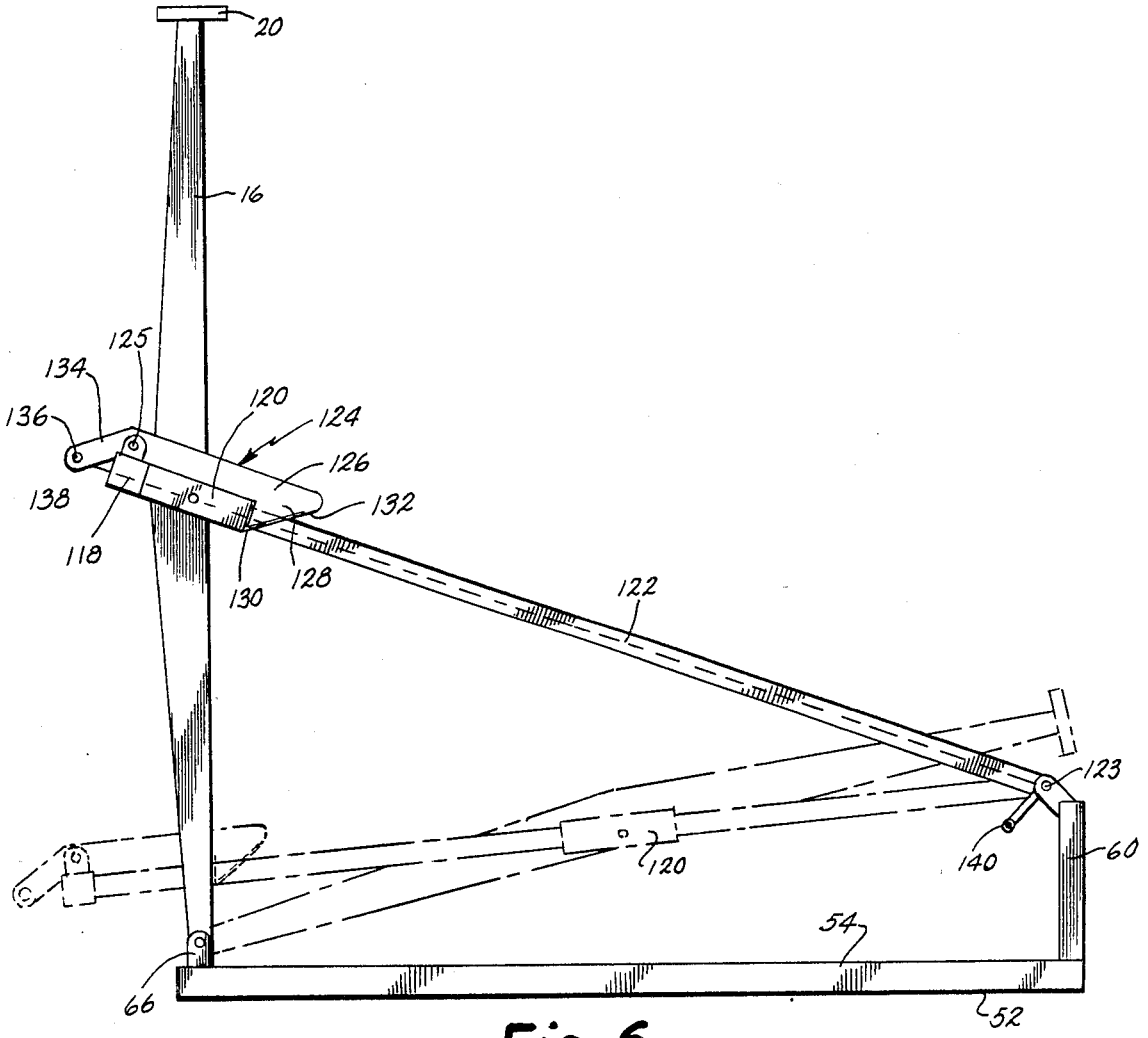
FIG. 6 is a side, elevational view showing the A-frame support braces and locking mechanism in accordance with the present invention.

The derrick frame brace or support system and locking mechanism for securing the frame in the erected position is another improvement to the derrick assembly which is disclosed in FIG. 1. As shown in FIG. 6, the improvement includes sleeves 120 which are pivotally attached to A-frame 16 and a pair of support braces 122 which are pivotally mounted to the upper ends of front struts 60 at pivot shafts 123. Preferably, support braces 122 have hollow interiors. The free end of each support brace 122 is inserted into and through sleeve 120. An end cap 118 having an outer diameter larger than the inner diameter of sleeve 120 is affixed to the end of the support brace in order to prevent the support brace from sliding out of sleeve 120.

A latch 124 is pivotally mounted to end cap 118 at pivot point 125. Latch 124 has a body 126 which is rectangular in shape and which extends toward the pivoted base of brace leg 122. A wedge-shaped or hook portion 128 extends perpendicularly from the free end of body 126 and has an inner face 130 which is perpendicular to the longitudinal axis of brace 122 and an outer face 132 which is acutely angled with respect to the longitudinal axis of brace 122. The distance between end cap 118 and inner face 130 is the same as or slightly greater than the longitudinal length of sleeve 120.

A tail lever 134 having a hole 136 at one end is attached to the pivoted end of latch 124 and extends outwardly and downwardly therefrom. A latch disengaging cable 138 is secured at one end to hole 136. Cable 138 is then inserted through the top of end cap 118 and through the hollow interior of brace 122. The other end of cable 138 is wrapped around brace pivot shaft 123. A crank 140 is rotatably connected to rotatable pivot shaft 123.

In operation, raising A-frame 16 to its erected, operating position simultaneously raises brace leg 122 which slidably engages with the A-frame via sleeve 120. The latching mechanism then engages with sleeve 120 once the A-frame is in its erected, vertical position. As the A-frame is raised, brace leg 122 slides through sleeve 120. Sleeve 120 pivots about its pivotal mounting so as to align its longitudinal axis with the longitudinal axis of the rising brace leg 122. As the A-frame erection process continues, the leading edge of sleeve 120 eventually comes into contact with the angled outer surface 132 of latch 124. This contact pushes latch 124 upward about its pivotal mounting such that the latch slides over the leading edge of the sleeve. Latch 124 continues to slide over sleeve 120 as support brace 122 slides through the sleeve. When the A-frame is vertical, sleeve 120 contacts end cap 118 which prevents any further sliding of brace 122 through the sleeve. At this point, the trailing edge of sleeve 120 passes the inner face 130 of latch 124. Latch 124 then falls by gravity back into place behind sleeve 120. Sleeve 120 is now securely engaged between end cap 118 and sleeve engaging member 128 which locks the A-frame into its erected, operating position.

To disengage the latching mechanism, crank 140 is turned which winds in the latch disengaging cable 138. Winding in the cable pulls on the free end of the tail lever 134 which in turn raises latch 124 about is pivot 125. When latch 124 is raised sufficiently, the sleeve engaging member 128 will clear the trailing edge of sleeve 120. At this point, brace leg 122 is free to slide through sleeve 120. A-frame 16 can then be lowered to its collapsed, transporting position, as shown by the dash lines in FIG. 6.

The brace and latch mechanism of the present invention provides a simple and positive lock to retain the A-frame in an upright position. The lock is activated by gravity and this enhances the reliability of its operation. The release cable is enclosed inside the brace and this protects it from damage or from being tangled with other lines or obstructions. Further, the locking mechanism can be located beyond the reach of the operator because the operator does not have to actually handle the locking mechanism. This permits support brace 122 to support the upper half of the A-frame which thus eliminates the need for auxiliary support cables or braces.

CABLE SLACKENING COMPENSATION SYSTEM

The derrick structure of the present invention supports a boom assembly and hook hoisting mechanism similar to that shown in FIG. 1. FIG. 1 illustrates a hook hoisting system which includes a winch 150 attached to lower cross bar 68 of the A-frame. A hoisting cable 152 extends from winch 150 upwardly along the vertical axis 148 of A-frame 16 to and over a pulley (not shown) rotatably supported on pivot shaft 154 of trunnion assembly 22. The cable then extends outwardly parallel to boom hoisting section 24 and over a pulley 156 supported on a bracket 158 disposed on the end of the hoisting boom section 24. A hook 160 is attached to the end of the cable 152.

As the A-frame of the FIG. 1 assembly is lowered, hoist cable 152 wraps around the pulleys and winch. This shortens the distance or length of the cable between the pulleys and the hook. Because the cable is fixed at one end to winch 150, the hooked end 160 of the cable retracts toward boom hoisting section 24. If the amount of cable retraction is greater than the original length of the cable hanging below boom hoisting section 24, the hook will jam into pulley 156 possibly causing cable 152 to snap.

Figures 7, 8:
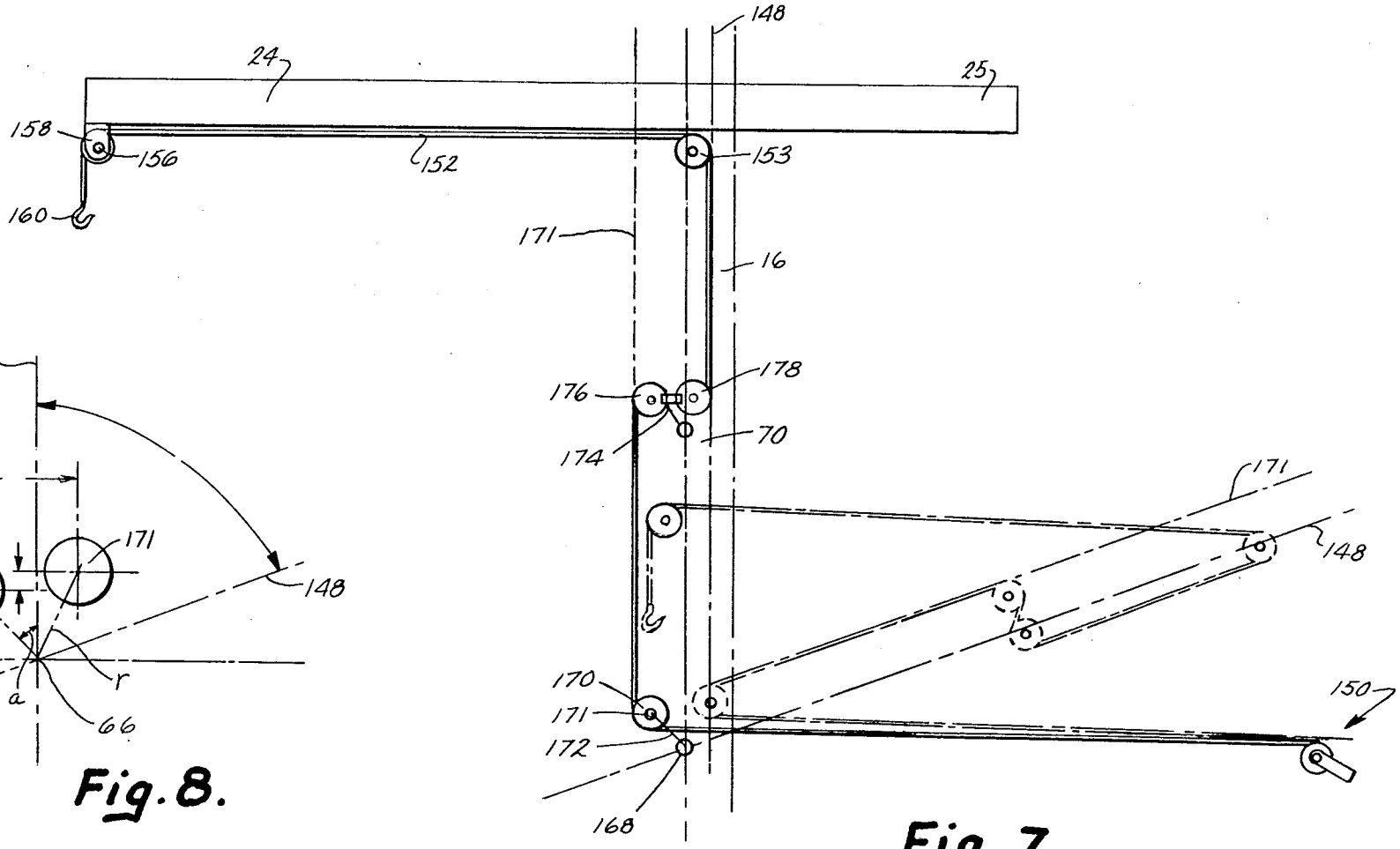
FIG. 7 is a schematic, side, elevational view showing the cable slackening compensation system in accordance with the present invention.
FIG. 8 is a schematic illustration showing a portion of the cable slackening compensation system.

FIGS. 7 and 8 illustrate the cable slackening system in accordance with the present invention which compensates for the cable wrapping effect which occurs when the A-frame is lowered and which thereby prevents the possibility of hook 160 retracting into pulley 156. In the cable slackening system of the present invention, hoisting winch 150 is fixedly secured to front cross brace member 56 rather than to the A-frame itself. Hoisting cable 152 is unreeled from winch 150 and extends to and around a guide or compensation pulley 170 which is rotatably mounted to a support arm 172 which in turn is connected to lower cross brace 68 of A-frame 16. Support arm 172 is attached to cross brace 68 such that axis 171 of pulley 170 is parallel to and offset from A-frame vertical axis 148. The cable then extends upwardly to and around a first pulley 176 and a second pulley 178 on A-frame 16. Cable 152 then continues along vertical axis 148 and pulley 153 and pulley 156. Pulley 153 is as shown in U.S. Pat. No. 4,068,762. Hook 160 is attached to the end of cable 152.

In operation, pulley 170 rotates through the arc defined by the radius r of support arm 172 as A-frame 16 is rotated about its pivot point 66 from a vertical position to a lowered position (see FIG. 8). As pulley 170 follows the arc traced by the support arm, it moves upward and forward, as seen in FIG. 8, thereby shortening the distance between pulley 170 and winch 150. The resulting slack in cable 152 compensates for the wrapping of that cable around the pulleys. The amount of slackening is determined by the length of support arm 172 and the angle "a" between the longitudinal axis or radius r defined by support arm 172 and vertical axis 148. The cable slackening system of the present invention compensates for the wrapping of cable 152 around the pulleys, thereby eliminating the possibility of the hooked end becoming jammed in boom pulley 156.

Thus, it will be appreciated that the present invention provides a collapsible boom and foldable derrick hoist assembly of relatively compact size which can be readily raised and lowered.

The A-frame erection system is mechanically less complex and easier to operate than those heretofore provided. The system is more reliable and relatively easy to manufacture and install. The support brace and locking mechanism is adapted for use with any pivotal derrick frame. The mechanism automatically locks the derrick frame in the erected position. This substantially increases the ease of use of the overall assembly. The cable compensation system makes it possible to rotate booms or spars in general relative to other structures without causing the cable routed therethrough to retract. This prevents jamming of hooks and cable fittings and prevents breaking of the cable. The compensation system is easily installed on existing derrick and hoist assemblies.

In view of the foregoing description, those of ordinary skill in the art will undoubtedly envision various modifications which would not depart from the inventive concepts disclosed. It is expressly intended, therefore, that the foregoing description is illustrative of the preferred embodiment only and is not to be considered limited. The true spirit and scope of the present invention will be determined by reference to the appended claims.

The embodiments of the invention in which an exclusive property or privilege is claimed as defined as follows:

1. A collapsible derrick assembly, comprising:

a base frame;

a derrick frame supported on said base frame for movement from a collapsed position to an erected position, said derrick frame including a base and pivot means connected to said base frame for pivotally connecting said base to said base frame at a fixed point; and derrick frame erection means for moving said derrick frame from the collapsed position to the erected position, said erection means comprising:

a track fixed on said base frame;

carriage means movable along said track and adapted to engage said derrick frame for rotating said derrick frame about said fixed pivot; and drive means connected to said carriage means for moving said carriage means along said track from a position out of contact with said derrick frame to a position in engagement with said derrick frame so that further movement along said track causes said carriage means to rotate said derrick frame about said fixed point to the erected position.

2. A collapsible derrick assembly as recited in claim 1, wherein said base frame includes side members and front and rear cross members attached to the ends of said side members and wherein said track is connected at one end to said rear cross frame member and at the other end to said front cross frame member.

3. A collapsible derrick assembly as recited in claim 2, wherein said track is inclined at an acute angle with respect to said base frame, said track sloping upwardly from said front cross member to said rear cross member, said rear end of said track lying above the pivotally mounted base of said derrick frame and said front end of said track lying below said derrick frame when said derrick frame is in its collapsed position.

4. A collapsible derrick assembly as recited in claim 3, wherein said track includes a pair of opposed, spaced guide rails, said carriage means spanning said rails.

5. A collapsible derrick assembly as recited in claim 4, wherein said derrick frame includes an A-frame having a pair of legs defining a truncated apex, the base of the legs of said A-frame being pivotally mounted to said base frame, and wherein said guide rails extend between said legs of said A-frame.

6. A collapsible derrick assembly as recited in claim 1, wherein said carriage means comprises:

a shaft; and a plurality of rollers rotatably mounted on said shaft and which engage with said track.

7. A collapsible derrick assembly as recited in claim 6, wherein said carriage means further comprises:

a frame connected to said shaft; and means attached to said shaft for connecting said carriage means to said drive means.

8. A collapsible derrick assembly as recited in claim 7, wherein said carriage means further includes at least one secondary roller rotatably mounted to said shaft and which rolls along said derrick frame as said carriage means moves along said track.

9. A collapsible derrick assembly as recited in claim 1, wherein said drive means for moving said carriage means along said track comprises:

a winch; and means for operatively connecting said winch to said carriage means, whereby turning said winch winds in said connecting means, thereby moving said carriage means along said track.

10. A collapsible derrick assembly as recited in claim 9, wherein said means for operatively connecting said winch to said carriage means comprises a first cable.

11. A collapsible derrick assembly as recited in claim 10, wherein said means for operatively connecting said winch to said carriage means further comprises:

a pulley block having a block frame and a first pulley rotatably mounted to said block frame, said first cable being connected to said winch and to said block frame; and a second cable attached at each end to said carriage means and defining a loop, the loop of said cable being reaved around said first pulley.

12. A collapsible derrick assembly as recited in claim 11, wherein said means for operatively connecting said winch to said carriage means further comprises a second pulley rotatably mounted to said block frame, one end of said first cable being connected to said winch, said first cable being reaved around said second pulley and then extending back toward said winch, the free end of said first cable being anchored adjacent said winch.

13. A collapsible derrick assembly as recited in claim 11, wherein said means for operatively connecting said winch to said carriage means further comprises a plurality of guide pulleys operatively engaged with said second cable to change the direction of travel of said second cable, thereby permitting said drive means to be contained within the area of said base frame.

14. A collapsible derrick assembly as recited in claim 1, further comprising a cable slackening means, attached to said derrick frame for use in conjunction with a hoisting cable arrangement adapted for mounting on said derrick, said arrangement including a hoist cable, a winch and a plurality of guide pulleys for compensating for the retraction of said hoisting cable which occurs as the result of said cable wrapping around its guide pulleys as the derrick frame is lowered from its erected position to its collapsed position.

15. A collapsible derrick assembly as recited in claim 14, wherein said cable slackening means includes an arm having an end thereof attached to said derrick frame and another end thereof having one of said guide pulleys rotatably mounted thereon, said arm being attached to said derrick frame such that the axis of said guide pulley is parallel to and offset from the pivot axis of said derrick frame, the radius and angle of offset being such that upon rotation of the derrick frame to its collapsed position, said guide pulley moves upward and laterally as it follows the arc traced by said support arm, whereby said movement of said pulley shortens the distance between said pulley and said winch, thereby causing a slackening of said cable which compensates for the wrapping of said cable around said guide pulleys.

16. A collapsible derrick assembly as recited in claim 1 further comprising:

a support brace pivotally connected at one end to said base frame; and locking means on said derrick frame for locking said support brace to said derrick frame when said derrick frame is in its erected position to prevent said derrick frame from rotating about its base.

17. A collapsible derrick assembly as recited in claim 16 wherein said locking means includes:

a sleeve pivoted to said derrick frame, said support brace extending through said sleeve.

18. A collapsible derrick assembly as recited in claim 17 wherein said locking means further includes:

a sleeve engaging means mounted on a free end of said support brace for engaging said sleeve when said derrick frame is in said erected position and locking said sleeve to said support brace.

19. A collapsible derrick assembly as recited in claim 18 wherein said sleeve engaging means includes:

an end cap secured to said free end of said brace;

a latch pivoted to said end cap, said latch including a hook portion dimensioned to slide over said sleeve and retain said sleeve between said end cap and said hook portion.

20. A collapsible derrick assembly as recited in claim 19 wherein said locking means further includes a latch release cable extending along said brace, said release cable having an end attached to said latch so that the latch will rotate to release said sleeve when the release cable is pulled.

21. A collapsible derrick assembly, comprising:

a base frame;

a derrick frame supported on said base frame for movement from a collapsed position to an erected position and including a base pivotally connected to said base frame; and derrick frame erection means for moving said derrick frame from the collapsed position to the erected position, said erection means comprising:

a track fixed on said base frame;

carriage means movable along said track and engaging said derrick frame for rotating said derrick frame; and drive means connected to said carriage means for moving said carriage means along said track and into engagement with said derrick frame, said carriage means comprising:

a shaft;

a plurality of rollers rotatably mounted on said shaft and which engage with said track;

a frame connected to said shaft; and means attached to said shaft for connecting said carriage means to said drive means, said carriage means further including at least one secondary roller rotatably mounted to said shaft and which rolls along said derrick frame as said carriage means moves along said track, and wherein said derrick frame includes:

an A-frame having a pair of legs defining a base and a truncated apex; and a flange attached to each leg of said A-frame for providing a flat, continuous surface upon which said secondary roller can roll as said carriage means moves along said track.

22. A collapsible derrick assembly as recited in claim 21, further comprising a cable slackening means, attached to said derrick frame for use in conjunction with a hoisting cable arrangement adapted for mounting on said derrick, said arrangement including a hoist cable, a winch and a plurality of guide pulleys for compensating for the retraction of said hoisting cable which occurs as the result of said cable wrapping around its guide pulleys as the derrick frame is lowered from its erected position to its collapsed position.

23. A collapsible derrick assembly as recited in claim 22, wherein said cable slackening means includes an arm having an end thereof attached to said derrick frame and another end thereof having one of said guide pulleys rotatably mounted thereon, said arm being attached to said derrick frame such that the axis of said guide pulley is parallel to the offset from the pivot axis of said derrick frame, the radius and angle of offset being such that upon rotation of the derrick frame to its collapsed position, said guide pulley moves upward and laterally as it follows the arc traced by said support arm, whereby said movement of said pulley shortens the distance between said pulley and said winch, thereby causing a slackening of said cable which compensates for the wrapping of said cable around said guide pulleys.

24. A collapsible derrick assembly as recited in claim 21 further comprising:

a support brace pivotally connected at one end to said base frame; and locking means on said derrick frame for locking said support brace to said derrick frame when said derrick frame is in its erected position to prevent said derrick frame from rotating about its base.

25. A collapsible derrick assembly as recited in claim 24 wherein said locking means includes:

a sleeve pivoted to said derrick frame, said support brace extending through said sleeve.

26. A collapsible derrick assembly as recited in claim 25 wherein said locking means further includes:

a sleeve engaging means mounted on a free end of said support brace for engaging said sleeve when said derrick frame is in said erected position and locking said sleeve to said support brace.

27. A collapsible derrick assembly as recited in claim 26 wherein said sleeve engaging means includes:

an end cap secured to said free end of said brace;

a latch pivoted to said end cap, said latch including a hook portion dimensioned to slide over said sleeve and retain said sleeve between said end cap and said hook portion.

28. A collapsible derrick assembly as recited in claim 27 wherein said locking means further includes a latch release cable extending along said brace, said release cable having an end attached to said latch so that the latch will rotate to release said sleeve when the release cable is pulled.

29. An apparatus for erecting a derrick frame from a collapsed position to an operating position about a pivot located at the lower end of the derrick frame, said apparatus comprising:

a fixed track;

movable means on said track for engaging said derrick frame; and drive means for moving said movable means along said track, whereby moving said movable means along said track toward said pivot rotates said derrick frame about said pivot from its collapsed, transporting position to its erected, operating position, said movable means comprising:

a shaft;

a plurality of rollers, rotatably mounted on said shaft and engaging said track;

a frame connected to said shaft; and means attached to said frame for connecting said movable means to said drive means, said movable means further comprising engaging means for engaging said derrick frame, and wherein said engaging means comprises a secondary roller rotatably mounted to said shaft and dimensioned to roll along said derrick frame.

30. An apparatus for erecting a derrick frame as recited in claim 29, wherein said movable means further comprises a plurality of guide flanges attached to said frame on both sides of said track engaging rollers, said flanges extending in a vertical direction below the level of said rollers and extending in a horizontal direction parallel to the direction of travel of said rollers, whereby when said movable means is engaged with said track, said guide rails extend alongside said track, thereby keeping said movable means on said track.

31. An apparatus for erecting a derrick frame as recited in claim 29, wherein said driving means comprises:

a winch; and a cable for operatively connecting said winch to said movable means.

32. An apparatus for erecting a derrick frame as recited in claim 31, wherein said driving means comprises:

a pulley block comprised of a block frame and a first pulley rotatably mounted to said block frame, said cable being connected at one end to said winch and at the other end to said block frame; and a second cable attached at each each to said movable means, the loop of said second cable as formed being operatively connected to said first pulley.

33. An apparatus for erecting a derrick frame as recited in claim 32, wherein said pulley block further comprises a second pulley rotatably mounted to said block frame and operatively connected to said first cable.

34. An apparatus for erecting a derrick frame as recited in claim 32, wherein said drive means further comprises a plurality of guide pulleys operatively engaging said second cable to change the direction of said second cable, thereby permitting said drive means to be contained in a small area.

35. A collapsible derrick assembly comprising:

a base frame;

a derrick frame supported on said base frame for movement from a collapsed position to an erected, operating position said derrick frame including a base and means for pivotally connecting said derrick frame base to said base frame;

at least one support brace having a free end and an end pivotally connected to said base frame;

locking means connected to said support brace and said derrick frame for securing said support brace to said derrick frame when said derrick frame is in its erected, operating positon, said locking means including a sleeve pivotally mounted to said derrick frame and which slidably receives said support brace, whereby when said derrick frame is raised or lowered, said support brace slides through said sleeve, and sleeve engaging means connected to said support brace for engaging said sleeve when said derrick frame is raised to its erected, operating position, said sleeve engaging means including an end cap mounted onto said support brace to stop said sleeve when said derrick frame reaches its erected, operating position, and a latch pivotally mounted to said end cap, said latch including a tail lever portion; and means attached to said tail lever for pivoting said latch to release the sleeve.

* * * * *

UNITED STATES PATENT AND TRADEMARK OFFICE

CERTIFICATE OF CORRECTION

PATENT NO. : 4,615,450

DATED : October 7, 1986

INVENTOR(S) : Dwight C. Kennard, Jr.

It is certified that error appears in the above-identified patent and that said Letters Patent is hereby corrected as shown below:

Column 2, line 30:
"bracke" should be --brace--;

Column 2, lines 34 and 35:
"auziliary" should be --auxiliary--;

Column 5, line 37:
"seconc" should be --second--;

Column 7, line 17:
"is" should be --its--;

Column 11, line 64:
"the" (first occurrence) should be --and--;

Column 13, line 14:
"each" (second occurrence) should be --end--; and

Column 13, line 15:
"as" should be --so--.

Signed and Sealed this

Twenty-first Day of April, 1987

*Attest:*

DONALD J. QUIGG

*Attesting Officer*

*Commissioner of Patents and Trademarks*